US005999154A

United States Patent [19]

Yoshioka

[11] Patent Number: 5,999,154

[45] Date of Patent: Dec. 7, 1999

[54] IMAGE DISPLAY METHOD AND ITS DEVICE

[75] Inventor: Kazuo Yoshioka, Tokyo, Japan

[73] Assignee: Mitsubishi Denki Kabushiki Kaisha, Tokyo, Japan

[21] Appl. No.: 08/879,703

[22] Filed: Jun. 20, 1997

[30] Foreign Application Priority Data

Feb. 3, 1997 [JP] Japan ..... 9-020549

[51] Int. Cl.[6] ..... G09G 3/36

[52] U.S. Cl. ..... 345/89; 345/63; 345/99

[58] Field of Search ..... 345/147, 89, 100, 345/97, 63, 60, 99

[56] References Cited

U.S. PATENT DOCUMENTS

| | | | |
|---|---|---|---|
| 5,491,496 | 2/1996 | Tomiyasu | 345/147 |
| 5,745,089 | 4/1998 | Taguchi et al. | 345/89 |
| 5,757,343 | 5/1998 | Nagakubo | 345/63 |
| 5,764,213 | 6/1998 | Tanaka et al. | 345/100 |
| 5,815,134 | 9/1998 | Nishi | 345/97 |

FOREIGN PATENT DOCUMENTS 6-242743 9/1994 Japan .

OTHER PUBLICATIONS

T. Shinoda, "AC Type Plasma Display," *Journal of Society of Electricity*, vol.116, No.8, 1996, pp. 518–521.

M. Seki et al., "Improvement in the Picture Quality on a 20–Inch Color Gas–Discharge TV Display," *Technical Report EID89–73 of Electrocommunications Society*, published Jan. 18, 1990, pp. 83–88.

*Primary Examiner*—Regina Liang
*Attorney, Agent, or Firm*—Burns, Doane, Swecker & Mathis, LLP

[57] ABSTRACT

An image display method and device for image display of $2^N$ gradation characterized by previously making a write timing number table expressed in a numeration with a base of M (M: the number of gradation levels set for scanning line selection sequence) in which data of a specific digit corresponds to the gradation level and data of other digits differs in every scanning line, selecting a scanning line and a gradation level by referring the timing numbers generated in the course of time to the write timing number table, writing display data corresponding to the selected gradation level in batch into pixels on the selected scanning line, and forming N (N≦M) images of single gradation, in which each image of single gradation includes all scanning lines.

14 Claims, 12 Drawing Sheets

FIG. 4

| | | GRADATION LEVEL | | | | | | | |
|---|---|---|---|---|---|---|---|---|---|
| | | 0 | 1 | 2 | 3 | 4 | 5 | 6 | 7 |
| | | WRITE /ERASE | WRITE /ERASE | WRITE /ERASE | WRITE /ERASE | WRITE /ERASE | WRITE /ERASE | WRITE /ERASE | WRITE /ERASE |
| SCANNING LINE | 1 | 001/002 | 003/005 | 006/012 | 014/024 | 025/045 | 047/107 | 110/210 | 212/412 |
| | 2 | 011/012 | 013/015 | 016/022 | 024/034 | 035/055 | 057/117 | 120/220 | 222/002 |
| | 3 | 021/022 | 023/025 | 026/032 | 034/044 | 045/065 | 067/127 | 130/230 | 232/012 |
| | 4 | 031/032 | 033/035 | 036/042 | 044/054 | 055/075 | 077/137 | 140/240 | 242/022 |
| | 5 | 041/042 | 043/045 | 046/052 | 054/064 | 065/105 | 107/147 | 150/250 | 252/032 |
| | 6 | 051/052 | 053/055 | 056/062 | 064/074 | 075/115 | 117/157 | 160/260 | 262/042 |
| | 7 | 061/062 | 063/065 | 066/072 | 074/104 | 105/125 | 127/167 | 170/270 | 272/052 |
| | 8 | 071/072 | 073/075 | 076/102 | 104/114 | 115/135 | 137/177 | 200/300 | 302/062 |
| | 9 | 101/102 | 103/105 | 106/112 | 114/124 | 125/145 | 147/207 | 210/310 | 312/072 |
| | 10 | 111/112 | 113/115 | 116/122 | 124/134 | 135/155 | 157/217 | 220/320 | 322/102 |
| | 11 | 121/122 | 123/125 | 126/132 | 134/144 | 145/165 | 167/227 | 230/330 | 332/112 |
| | 12 | 131/132 | 133/135 | 136/142 | 144/154 | 155/175 | 177/237 | 240/340 | 342/122 |
| | 13 | 141/142 | 143/145 | 146/152 | 154/164 | 165/205 | 207/247 | 250/350 | 352/132 |
| | 14 | 151/152 | 153/155 | 156/162 | 164/174 | 175/215 | 217/257 | 260/360 | 362/142 |
| | 15 | 161/162 | 163/165 | 166/172 | 174/204 | 205/225 | 227/267 | 270/370 | 372/152 |
| | 16 | 171/172 | 173/175 | 176/202 | 204/214 | 215/235 | 237/277 | 300/400 | 402/162 |
| | 17 | 201/202 | 203/205 | 206/212 | 214/224 | 225/245 | 247/307 | 310/410 | 412/172 |
| | 18 | 211/212 | 213/215 | 216/222 | 224/234 | 235/255 | 257/317 | 320/420 | 002/202 |
| | 19 | 221/222 | 223/225 | 226/232 | 234/244 | 245/265 | 267/327 | 330/010 | 012/212 |
| | 20 | 231/232 | 233/235 | 236/242 | 244/254 | 255/275 | 277/337 | 340/020 | 022/222 |
| | 21 | 241/242 | 243/245 | 246/252 | 254/264 | 265/305 | 307/347 | 350/030 | 032/232 |
| | 22 | 251/252 | 253/255 | 256/262 | 264/274 | 275/315 | 317/357 | 360/040 | 042/242 |
| | 23 | 261/262 | 263/265 | 266/272 | 274/304 | 305/325 | 327/367 | 370/050 | 052/252 |
| | 24 | 271/272 | 273/275 | 276/302 | 304/314 | 315/335 | 337/377 | 400/060 | 062/262 |
| | 25 | 301/302 | 303/305 | 306/312 | 314/324 | 325/345 | 347/407 | 410/070 | 072/272 |
| | 26 | 311/312 | 313/315 | 316/322 | 324/334 | 335/355 | 357/417 | 420/100 | 102/302 |
| | 27 | 321/322 | 323/325 | 326/332 | 334/344 | 345/365 | 367/007 | 010/110 | 112/312 |
| | 28 | 331/332 | 333/335 | 336/342 | 344/354 | 355/375 | 377/017 | 020/120 | 122/322 |
| | 29 | 341/342 | 343/345 | 346/352 | 354/364 | 365/405 | 407/027 | 030/130 | 132/332 |
| | 30 | 351/352 | 353/355 | 356/362 | 364/374 | 375/415 | 417/037 | 040/140 | 142/342 |
| | 31 | 361/362 | 363/365 | 366/372 | 374/404 | 405/005 | 007/047 | 050/150 | 152/352 |
| | 32 | 371/372 | 373/375 | 376/402 | 404/414 | 415/015 | 017/057 | 060/160 | 162/362 |

(DATA IS DESCRIBED IN OCTAL NUMERATION.)

FIG. 6

| | | GRADATION LEVEL | | | | | | |
|---|---|---|---|---|---|---|---|---|
| | | 0 | 1 | 2 | 3 | 4 | 5 | 6 |
| | | WRITE /ERASE | WRITE /ERASE | WRITE /ERASE | WRITE /ERASE | WRITE /ERASE | WRITE /ERASE | WRITE /ERASE |
| SCANNING LINE | 1 | 001/002 | 003/005 | 006/013 | 014/025 | 030/052 | 055/132 | 142/263 |
| | 2 | 011/012 | 013/015 | 016/023 | 024/035 | 040/062 | 065/142 | 152/303 |
| | 3 | 021/022 | 023/025 | 026/033 | 034/045 | 050/102 | 105/152 | 162/313 |
| | 4 | 031/032 | 033/035 | 036/043 | 044/055 | 060/112 | 115/162 | 202/323 |
| | 5 | 041/042 | 043/045 | 046/053 | 054/065 | 100/122 | 125/202 | 212/333 |
| | 6 | 051/052 | 053/055 | 056/063 | 064/105 | 110/132 | 135/212 | 222/343 |
| | 7 | 061/062 | 063/065 | 066/103 | 104/115 | 120/142 | 145/222 | 232/353 |
| | 8 | 101/102 | 103/105 | 106/113 | 114/125 | 130/152 | 155/232 | 242/363 |
| | 9 | 111/112 | 113/115 | 116/123 | 124/135 | 140/162 | 165/242 | 252/403 |
| | 10 | 121/122 | 123/125 | 126/133 | 134/145 | 150/202 | 205/252 | 262/413 |
| | 11 | 131/132 | 133/135 | 136/143 | 144/155 | 160/212 | 215/262 | 302/423 |
| | 12 | 141/142 | 143/145 | 146/153 | 154/165 | 200/222 | 225/302 | 312/433 |
| | 13 | 151/152 | 153/155 | 156/163 | 164/205 | 210/232 | 235/312 | 322/003 |
| | 14 | 161/162 | 163/165 | 166/203 | 204/215 | 220/242 | 245/322 | 332/013 |
| | 15 | 201/202 | 203/205 | 206/213 | 214/225 | 230/252 | 255/332 | 342/023 |
| | 16 | 211/212 | 213/215 | 216/223 | 224/235 | 240/262 | 265/342 | 352/033 |
| | 17 | 221/222 | 223/225 | 226/233 | 234/245 | 250/302 | 305/352 | 362/043 |
| | 18 | 231/232 | 233/235 | 236/243 | 244/255 | 260/312 | 315/362 | 402/053 |
| | 19 | 241/242 | 243/245 | 246/253 | 254/265 | 300/322 | 325/402 | 412/063 |
| | 20 | 251/252 | 253/255 | 256/263 | 264/305 | 310/332 | 335/412 | 422/103 |
| | 21 | 261/262 | 263/265 | 266/303 | 304/315 | 320/342 | 345/422 | 432/113 |
| | 22 | 301/302 | 303/305 | 306/313 | 314/325 | 330/352 | 355/432 | 002/123 |
| | 23 | 311/312 | 313/315 | 316/323 | 324/335 | 340/362 | 365/002 | 012/133 |
| | 24 | 321/322 | 323/325 | 326/333 | 334/345 | 350/402 | 405/012 | 022/143 |
| | 25 | 331/332 | 333/335 | 336/343 | 344/355 | 360/412 | 415/022 | 032/153 |
| | 26 | 341/342 | 343/345 | 346/353 | 354/365 | 400/422 | 425/032 | 042/163 |
| | 27 | 351/352 | 353/355 | 356/363 | 364/405 | 410/432 | 435/042 | 052/203 |
| | 28 | 361/362 | 363/365 | 366/403 | 404/415 | 420/002 | 005/052 | 062/213 |
| | 29 | 401/402 | 403/405 | 406/413 | 414/425 | 430/012 | 015/062 | 102/223 |
| | 30 | 411/412 | 413/415 | 416/423 | 424/435 | 440/022 | 025/102 | 112/233 |
| | 31 | 421/422 | 423/425 | 426/433 | 434/005 | 010/032 | 035/112 | 122/243 |
| | 32 | 431/432 | 433/435 | 436/003 | 004/015 | 020/042 | 045/122 | 132/253 |

(DATA IS DESCRIBED IN HEPTAL NUMERATION.)

FIG. 9

| | | GRADATION LEVEL | | | | | | |
|---|---|---|---|---|---|---|---|---|
| | | 0 | 1 | 2 | 3 | 4 | 5 | 6 |
| | | WRITE /ERASE | WRITE /ERASE | WRITE /ERASE | WRITE /ERASE | WRITE /ERASE | WRITE /ERASE | WRITE /ERASE |
| SCANNING LINE | 1 | 001/002 | 003/005 | 006/013 | 014/025 | 030/052 | 055/132 | 142/263 |
| | 2 | 011/012 | 013/015 | 016/023 | 024/035 | 040/062 | 065/142 | 152/003 |
| | 3 | 021/022 | 023/025 | 026/033 | 034/045 | 050/102 | 105/152 | 162/013 |
| | 4 | 031/032 | 033/035 | 036/043 | 044/055 | 060/112 | 115/162 | 202/023 |
| | 5 | 041/042 | 043/045 | 046/053 | 054/065 | 100/122 | 125/202 | 212/033 |
| | 6 | 051/052 | 053/055 | 056/063 | 064/105 | 110/132 | 135/212 | 222/043 |
| | 7 | 061/062 | 063/065 | 066/103 | 104/115 | 120/142 | 145/222 | 232/053 |
| | 8 | 101/102 | 103/105 | 106/113 | 114/125 | 130/152 | 155/232 | 242/063 |
| | 9 | 111/112 | 113/115 | 116/123 | 124/135 | 140/162 | 165/242 | 252/103 |
| | 10 | 121/122 | 123/125 | 126/133 | 134/145 | 150/202 | 205/252 | 262/113 |
| | 11 | 131/132 | 133/135 | 136/143 | 144/155 | 160/212 | 215/262 | 002/123 |
| | 12 | 141/142 | 143/145 | 146/153 | 154/165 | 200/222 | 225/002 | 012/133 |
| | 13 | 151/152 | 153/155 | 156/163 | 164/205 | 210/232 | 235/012 | 022/143 |
| | 14 | 161/162 | 163/165 | 166/203 | 204/215 | 220/242 | 245/022 | 032/153 |
| | 15 | 201/202 | 203/205 | 206/213 | 214/225 | 230/252 | 255/032 | 042/163 |
| | 16 | 211/212 | 213/215 | 216/223 | 224/235 | 240/262 | 265/042 | 052/203 |

(DATA IS DESCRIBED IN HEPTAL NUMERATION.)

FIG. 12

| | | GRADATION LEVEL (LIGHT EMISSION TIME) | | | | | | | | | | | | | |
|---|---|---|---|---|---|---|---|---|---|---|---|---|---|---|---|
| | | 0 ($2^0$T) | 1 ($2^1$T) | 2 ($2^2$T) | 3 ($2^3$T) | 4 ($2^4$T) | 5 ($2^5$T) | 6 ($2^6$T) | 7 ($2^7$T) | 8 ($2^8$T) | 9 ($2^9$T) | 10 ($2^{10}$T) | 11 ($2^{11}$T) | 12 ($2^{12}$T) | 13 ($2^{13}$T) |
| LUMINANCE ON DISPLAY SCREEN | MAX | 0 | 0 | 0 | 0 | $D_0$ | $D_1$ | $D_2$ | $D_3$ | $D_4$ | $D_5$ | $D_6$ | $D_7$ | $D_8$ | $D_9$ |
| | 1/2 | 0 | 0 | 0 | $D_0$ | $D_1$ | $D_2$ | $D_3$ | $D_4$ | $D_5$ | $D_6$ | $D_7$ | $D_8$ | $D_9$ | 0 |
| | 1/4 | 0 | 0 | $D_0$ | $D_1$ | $D_2$ | $D_3$ | $D_4$ | $D_5$ | $D_6$ | $D_7$ | $D_8$ | $D_9$ | 0 | 0 |
| | 1/8 | 0 | $D_0$ | $D_1$ | $D_2$ | $D_3$ | $D_4$ | $D_5$ | $D_6$ | $D_7$ | $D_8$ | $D_9$ | 0 | 0 | 0 |
| | 1/16 | $D_0$ | $D_1$ | $D_2$ | $D_3$ | $D_4$ | $D_5$ | $D_6$ | $D_7$ | $D_8$ | $D_9$ | 0 | 0 | 0 | 0 |

IMAGE DISPLAY METHOD AND ITS DEVICE

BACKGROUND OF THE INVENTION

The present invention relates to an image display method for gradation display by display means having pixels arranged in a matrix, and a device used for its execution.

Recently, image display devices of flat panel type using LCD (liquid crystal display), PDP (plasma display panel), and the like are used in various fields.

In this kind of image display device, generally, plural pixels are arranged in a matrix, scanning lines are disposed in the horizontal direction, and data lines, in the vertical direction. Accordingly, by selecting an arbitrary scanning line, display data can be written in batch from the data line into the pixels on that scanning line. By writing in this way while sequentially selecting all scanning lines for composing one screen, display data can be written into all pixels, and one image is formed.

That is, the image display device of flat panel type employs a different control system from the CRT (cathode ray tube) for scanning an electron beam continuously from top to bottom, and from left to right.

As an example of a device employing such control method, an image display device using PDP is disclosed in "Improvement in the Picture Quality on a 20-Inch Color Gas-Discharge TV Display" in Technical Report EID89-73 of Electrocommunications Society (published Jan. 18, 1990).

FIG. 1 is a block diagram showing an example of constitution of essential parts of the conventional image display device using PDP. This image display device comprises a display unit 20 having plural pixels arranged in a matrix, a cathode driving circuit 21 for driving the cathode of a display element for composing each pixel 200, an anode driving circuit 22 for driving the anode of a display element, an auxiliary anode driving circuit 221, a display control unit 23, and a field memory 24 for storing and holding display data.

In the display unit 20, moreover, plural cathode lines 201 are disposed in the horizontal direction, and plural anode lines 202 and auxiliary anode lines 203 are disposed in the vertical direction. The cathode of each pixel 200 is connected to one cathode line 201, and the anode is connected to one anode line 202.

Using this image display device, first, a method of displaying an image of single gradation will be described.

The display control unit 23 selects one out of the plural cathode lines 201. The cathode driving circuit 21 drives the selected cathode line 201 at a predetermined voltage level, and allows of writing into each pixel 200 on the selected cathode line 201. The display control unit 23 outputs an address to the field memory 24. The field memory 24 gives display data corresponding to each pixel 200 on the selected cathode line 201 on the basis of this address. The display data is on/off data corresponding to lighting or extinguishing of each pixel in the case of data for forming an image of single gradation.

The anode driving circuit 22 drives each anode line 202 at a predetermined voltage level in accordance with the display data, and writes display data into each pixel 200 on the selected cathode line 201.

The display control unit 23 selects different cathode lines 201 sequentially, and repeats same operation, so that display data can be written into all pixels 200 for composing the display unit 20, thereby displaying the image of single gradation.

Meanwhile, the auxiliary anode driving circuit 221 is a circuit for decreasing the delay time for starting discharge by discharging with preliminal auxiliary the pixels 200 before writing display data by the anode driving circuit 22.

Using the same image display device, a method of displaying an image having gradations (gradation image) is described. FIG. 2 is an explanatory diagram showing a method of displaying an image of $2^8$ gradations. The period required for forming one gradation image is called one field, and one field is divided into periods called sub-fields. In each sub-field, an image of single gradation is displayed, and by combining images of such single gradation, a gradation image can be displayed in one field.

In the case of gradation display, usually, the number of gradations is selected in $2^N$ for the ease of control, and the division of the period of one field by this integer N is one sub-field. In the case of display in $2^N$ gradations, the display data can be expressed in binary notation in N bits, and each sub-field corresponds to each bit of display data. That is, by defining the light emission time in each sub-field at a ratio of $2^K$ (K=0, 1, . . . , N−1), each image of single gradation is weighted of luminance corresponding to each light emission time, so that an image of $2^N$ gradations can be displayed.

In FIG. 2, supposing eight divided sub-fields to be seventh sub-field, sixth sub-field, fifth sub-field, zeroth sub-field, the display unit 20 is driven according to the seventh bit (MSB) of display data in the seventh sub-field, the sixth bit of display data in the sixth sub-field, the fifth bit of display data in the fifth sub-field, and so forth, and the zeroth bit (LSB) of display data in the zeroth sub-field.

In each sub-field, each cathode line 201 is selected sequentially, and display data is written in sequentially, as a result each pixel 200 to emit light starts to emit light sequentially. After lapse of different light emission time preset in each sub-field, each cathode line 201 is sequentially selected for extinguishing, and each pixel 200 is extinguished sequentially.

The light emission (display) time in each sub-field is, supposing to be 1 in the zeroth sub-field, 2 in the first sub-field, 4 in the second sub-field, 8 in the third sub-field, 16 in the fourth sub-field, 32 in the fifth sub-field, 64 in the sixth sub-field, and 128 in the seventh sub-field according to weighting by ratio, and, as a result, display of $2^8$ gradations is obtained.

In such conventional image display device, the light emission (display) time in the period of one field is short, and the utility rate of light emission time (the rate of light emission time in the period of one field) is very small. Therefore, as compared with the light emission performance of the display device itself, only a dark display is made.

For example, specifically describing by referring to FIG. 2, supposing the maximum light emission time in the seventh sub-field to be 100, it is 50 in the sixth sub-field, in the fifth sub-field, decreasing to half thereafter, and 0.78125 in the zeroth sub-field. Hence, the possible display time in the period of one field is 100+50+25+12.5+ 6.25+3.125+ 1.5625+0.78125=199.21875, and therefore if displayed at maximum brightness, only about 25% of the period of one field 100×8 is utilized, and it is very inefficient.

In "AC Type Plasma Display" in Journal of Society of Electricity, Vol. 116, No. 8, 1996, a method of driving the sub-fields by dividing the sub-fields further into the address period common in time and sustain period in the whole area. More specifically, in the address period, a feeble discharge is generated by scanning in every line according to the display data, and the wall charge is first accumulated in the display cells of the entire panel surface. Afterwards, in the sustain period, sustain pulses are applied simultaneously in display cells of the whole screen, and discharge is continued in the cells in which wall charge is formed, and the display is performed. Since the pulse applied in the address period can be narrowed, it is possible to drive in a very short period of 3 $\mu$s or less per line when one second is composed of 60 frames each of which is divided into eight sub-fields.

Japanese Patent Application Laid-Open No. 6-242743 (1994) discloses a display method of enhancing the rate of display period executed in one field, by scanning the scanning lines at specified intervals changing gradually, and driving the display means using data of each bit of display data according to the intervals.

BRIEF SUMMARY OF THE INVENTION

The present invention has been devised to solve the above problems. It is an object of the present invention to provide an image display method capable of enhancing the rate of the period contributing to display within the period of one field, and obtaining a bright display image, and a device used in execution thereof.

According to the image display method and device of the invention, a table of writing timing number expressed in a numeration with a base of M (M: the number of gradation levels on scanning line selection sequence) in which data of specific digit corresponds to the gradation level and data of other digits differs in every scanning line is created preliminarily, and stored in writing control means. Counting timing signals generated upon lapse of every specified time, a timing number is generated to be converted to the number in the numeration with the base of M, and by referring the generated timing number to the timing number table, a scanning line and a gradation level are selected. In pixels on the selected scanning line, display data corresponding to the selected gradation level is written in batch, and N ($N \leqq M$) images of single gradation—each image of single gradation includes all scanning lines—are formed, as a result the image of $2^N$ gradations is displayed in the display unit in which pixels are arranged in a matrix. Therefore, without overlap of timing of writing selection between different scanning lines and between different gradation levels, efficient writing control can be achieved.

In the invention, after the lapse of display period corresponding to the gradation level at the time of writing for the selected scanning line, the same scanning line is selected for erasing data. After erasing data, the same scanning line is selected in at the timing when data of specific digit of timing number corresponds to next gradation level and display data is then written. Therefore, the extinguishment (non-display) time is decreased, and the utility rate of the light emission (display) time in one field can be increased, so that a bright image can be displayed. In the same pixels, when new display data is written, the existing display data is lost, and therefore in the case of the constitution for writing immediately after selecting to erase, it may be composed so that the write controlling means may not select for erasure.

The data in the lowest digit of the timing number may correspond to the gradation level, and the data of higher digit than this digit may be different in every scanning line.

In the invention, moreover, in order that the product of the number of scanning lines belonging to each group and number M of gradation level may be $2^M$ or less, the scanning lines are divided into plural groups, and the scanning line section is executed according to the timing number in parallel for the divided groups. When the base M of timing number is equal to the number N of images of single gradation, in order that the product of the number of scanning lines belonging to each group and number N of images of single gradation may be $2^N$ or less, scanning lines are divided into plural groups, and the scanning line selection is executed according to the timing signal in parallel for the divided groups. As a result, plural scanning lines can be selected simultaneously for writing, the assumed number of scanning lines is decreased, the period of one field is shortened, or the frequency of timing signal may be decreased.

Further, in the invention, if the number M of gradation levels is greater than the number N of images of single gradation, each luminance level corresponding to each image of single gradation is shifted according to the desired luminance, so that the brightness of the display image may be controlled. Thus, the brightness of the entire screen can be easily controlled.

Also in the invention, if the number M of gradation levels is greater than the number N of images of single gradation, the luminance itself corresponding to each image of single gradation is changed, so that the brightness of the display image may be controlled. Thus, the brightness of the entire screen may be controlled more finely.

The above and further objects of the invention will more fully be apparent from the following detailed description with accompanying drawings.

BRIEF DESCRIPTION OF THE SEVERAL VIEWS OF THE DRAWINGS

FIG. 4 is a diagram showing a timing number table used in embodiment 1;

FIG. 6 is a diagram showing a timing number table used in embodiment 2;

FIG. 9 is a diagram showing a timing number table used in embodiment 3;

FIG. 12 is a conceptual diagram showing a method of controlling the brightness of the entire image.

DETAILED DESCRIPTION OF THE INVENTION

Figure 1:
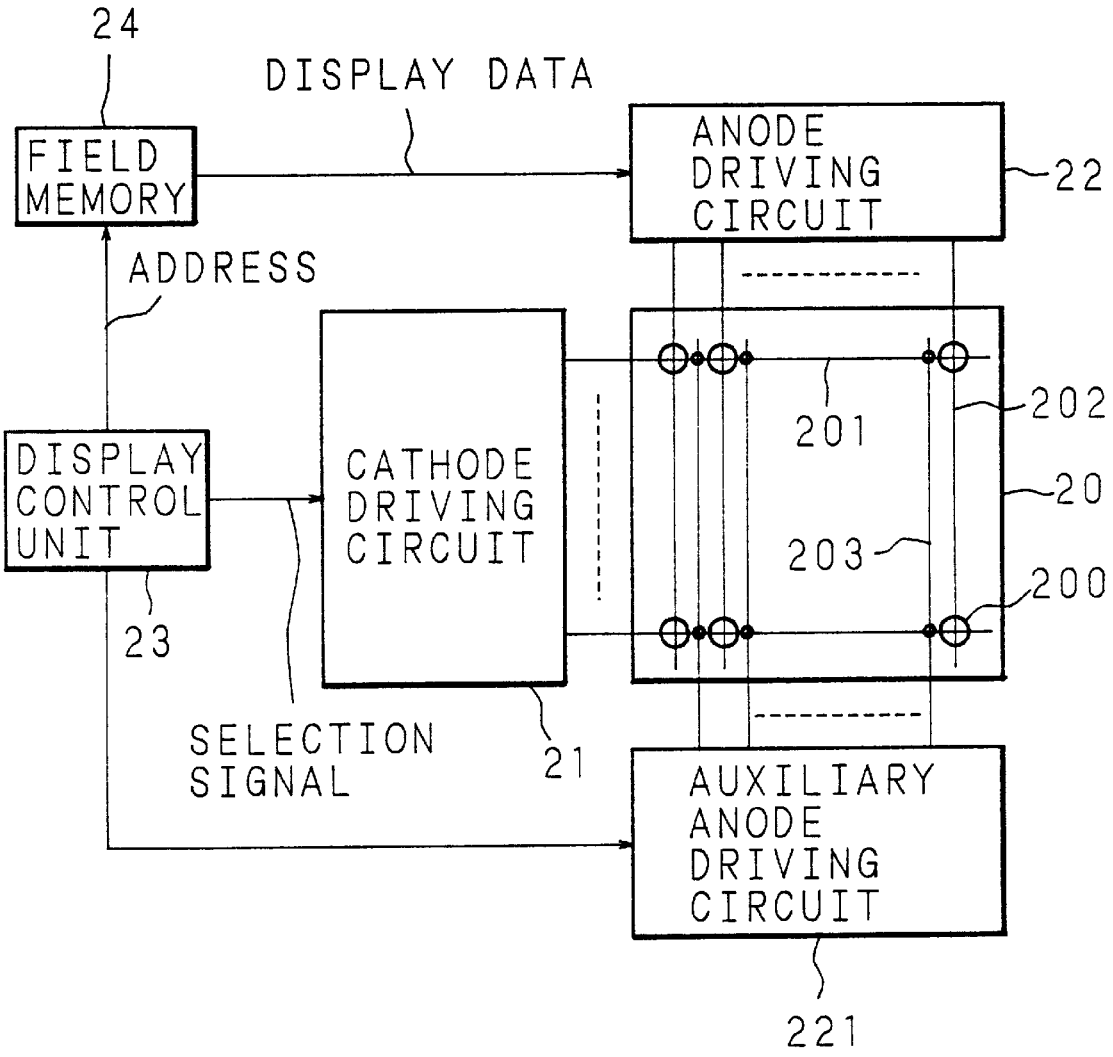
FIG. 1 PRIOR ART
FIG. 1 is a block diagram showing a constitution of a conventional image display device.
Figure 2:
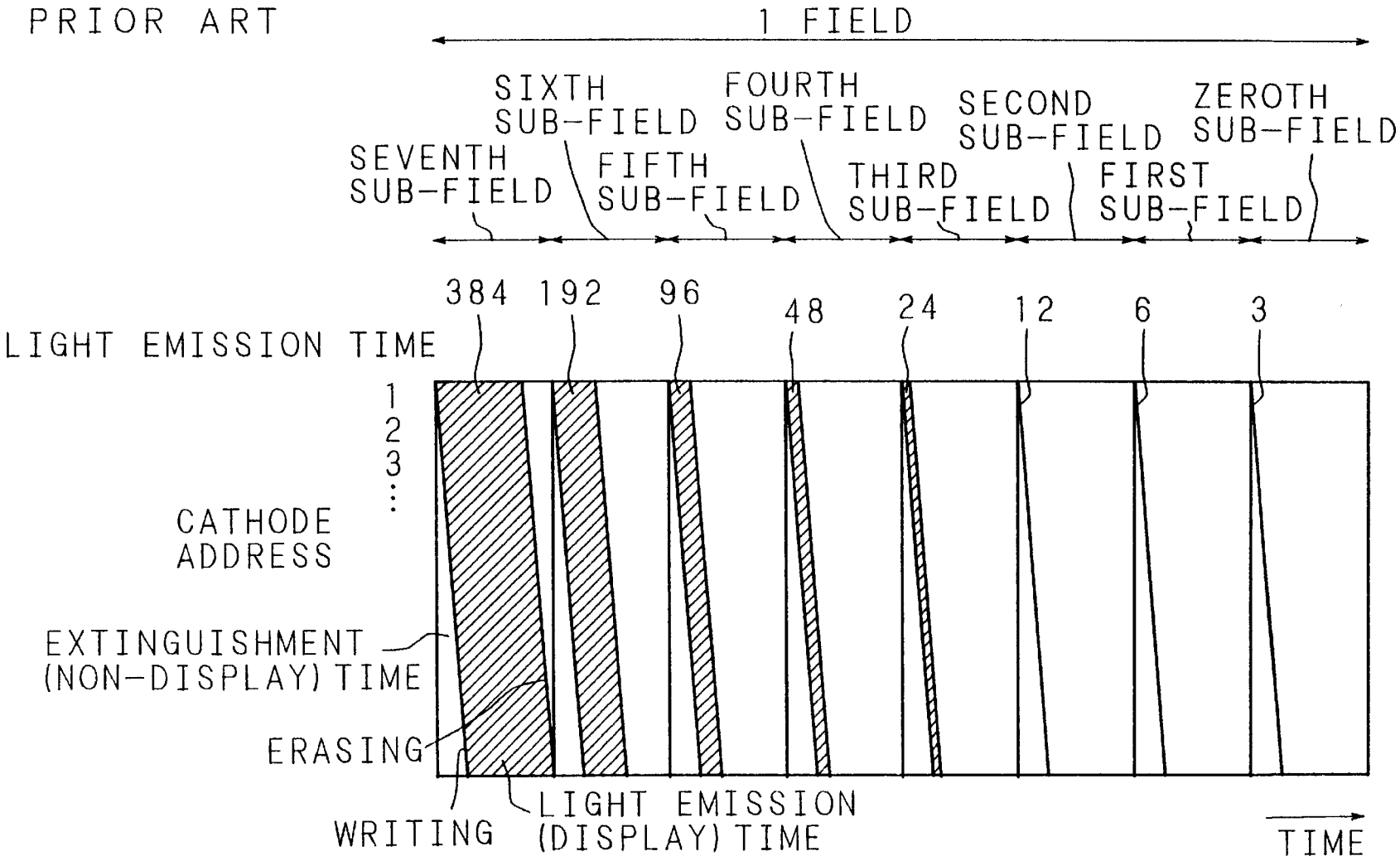
FIG. 2 PRIOR ART
FIG. 2 is a diagram showing a display method of gradation image by a conventional image display device.

Referring now to the drawings, embodiments of the invention are described in detail below.

Embodiment 1

Figure 3:
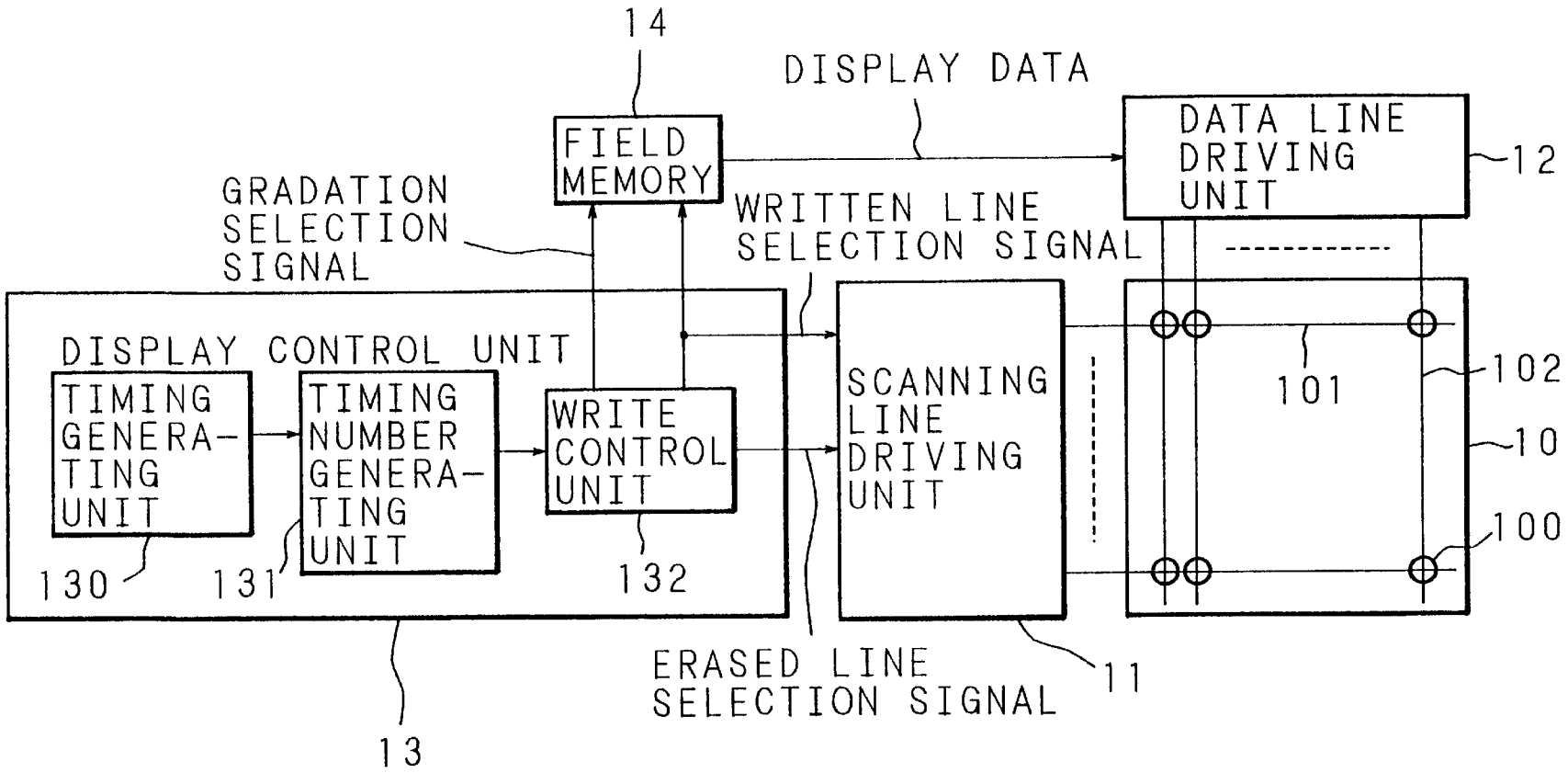
FIG. 3 is a block diagram showing a constitution of an image display device according to embodiment 1.

FIG. 3 is a block diagram showing essential parts of an image display device according to embodiment 1, showing a case of PDP. This image processing device is a device for displaying an image of $2^N$ gradations, and comprises a display unit 10, a scanning line driving unit 11, a data line driving unit 12, a display control unit 13, and a field memory 14. The display control unit 13 includes a timing generating unit 130, a timing number generating unit 131, and a write control unit 132. Each one of these blocks is described below.

In the display unit 10 plural pixels 100 are arranged in a matrix, plural scanning lines 101 in the horizontal direction are disposed, and plural data lines 102 in the vertical direction. The cathode of each pixel 100 is connected to any one scanning line 101, and the anode is connected to any one data line 102. Therefore, by selecting the scanning line 101, a series of pixels 100 arranged in the horizontal direction can be selected, and display data can be written into the selected pixels 100 in batch from the data line 102.

The timing generating unit 130 is a circuit for issuing a timing signal upon every lapse of predetermined time (calibration period T), and, for example, it is composed of a clock signal generating circuit having a crystal oscillator.

The timing number generating unit 131 is a circuit for counting the timing signals, and issuing the binary counting result as timing number. For example, it may be composed of an up-counter circuit or a down-counter circuit using flip-flop. Herein, an example of up-counter circuit is described.

The write control unit 132 is a circuit for controlling the timing when writing display data, and performs selection of the scanning line 101 for writing (writing selection) and selection of the gradation level for writing. The write control unit 132 also controls the timing for erasing the display data, and selects the scanning line 101 for erasing (erasing selection).

The write selection timing is preliminarily obtained as the timing data corresponding to the timing number. Similarly, the timing of erase selection is also preliminarily obtained as the timing data corresponding to the timing number. The write control unit 132 stores and holds the set of these timing data as the timing number table, and selects the scanning line and gradation level by reading out the data corresponding to the timing number from these timing data.

The gradation level means each period on the scanning line selection sequence for forming each image of single gradation for composing a gradation image. That is, the gradation level corresponds to the luminance level of each image of single gradation, and corresponds to the sub-field in the prior art. The timing number is converted the number in a numeration with the base of the number M of gradation levels to be used.

In this embodiment, a case of using eight gradation levels, from level 0 to level 7, and displaying an image in $2^8$ gradations (N=M) is explained. From gradation level 0 to gradation level 7, corresponding to from luminance level 0 to luminance level 7, the luminance becomes higher in this sequence. That is, each light emission time is $2^0$, $2^1$, $2^2$, $2^3$, $2^4$, $2^5$, $2^6$, and $2^7$.

Each timing data for composing the timing number table corresponds to each one of the eight luminance levels without overlap. That is, each gradation level is selected in correspondence with the data of the lowest digit in the case of expressing the timing number in octal notation. The scanning line is selected in correspondence with the data of higher digit than this lowest digit. Therefore, the write control unit 132 can select the gradation level on the basis of the data of the lowest digit of the timing number expressed in octal notation, and can also select the scanning line 101 on the basis of the data of higher digit.

The field memory 14 is a memory circuit for holding display data of $2^8$ gradations, and reads out specified display data on the basis of the selected scanning line and the selected gradation level and sends out into the data line driving unit 12.

The scanning line driving unit 11 is a circuit for driving the scanning line 101 selected by the write control unit 132 at a specified voltage level, and setting each pixel 100 on the scanning line 101 so as to be ready to write display data in.

The data line driving unit 12 is a circuit for driving each data line 102 at a specified voltage level in accordance with the display data issued from the field memory 14, and writing display data into each pixel 100 on the selected scanning line 101.

A method of display of $2^8$ gradations by this image display device is specifically described below by referring to FIG. 4.

FIG. 4 is a diagram showing an example of timing number table, in which concerning each pixel of the display unit 10, an example of writing and erasing timing of each gradation level is expressed by a timing number, arranging the gradation levels in the lateral direction, and the scanning lines in the longitudinal direction. In this diagram, the timing number is indicated in octal numeration with three digits. In this specification, subscripts such as $_{(7)}$n, $_{(8)}$, $_{(10)}$ indicate the heptal, octal, and decimal notation.

First, the explanation relates to the first scanning line. The first scanning line is the scanning line 101 placed in the highest stage of the display unit 10, and the second scanning line, the third scanning line, . . . are sequentially arranged in the downward direction, and the thirty-second scanning line is disposed in the lowest stage.

At the time point of timing number $\mathbf{001}_{(8)}$, by selecting the first scanning line for writing, the write sequence of display data starts. At this time, display data of gradation level 0 is written into each of the pixels on the first scanning line. The gradation level 0 corresponds to the sub-field 0 in the prior art, and its light emission (display) time is the shortest $\mathbf{1}_{(8)}$. Therefore, at the time point of timing number $\mathbf{002}_{(8)}$, the first scanning line is selected for erasing.

Furthermore, at the next time point of timing number $\mathbf{003}_{(8)}$, the first scanning line is selected for writing. At this time, display data of next gradation level, that is, gradation level 1 is written into the pixels on the first scanning line. The gradation level 1 corresponds to the sub-field 1 in the prior art, and its light emission (display) time is $\mathbf{2}_{(8)}$. Therefore, at the time point of timing number $\mathbf{005}_{(8)}$, the first scanning line is selected for erasing.

Exactly in the same manner, as to the gradation level 2, writing selection is executed at the time point of timing number $\mathbf{006}_{(8)}$, and erasing selection is performed at the point of timing number $\mathbf{012}_{(8)}$ after the lapse of light emission time $\mathbf{4}_{(8)}$. In succession, writing selection of gradation level 3 is executed, but at the next timing number $\mathbf{013}_{(8)}$, the lowest digit is "3", which in already used in the lowest digit of the timing number $\mathbf{003}_{(8)}$ for writing selection of gradation level 1. Accordingly, at the time point of further next timing number $\mathbf{014}_{(8)}$, writing selection is executed, and erasing selection is performed at the time point of timing number $\mathbf{024}_{(8)}$ after the lapse of light emission time $\mathbf{10}_{(8)}$.

As for the gradation level 4, writing selection is executed at the next time point of timing number $\mathbf{025}_{(8)}$, and erasing selection is performed at the point of timing number $\mathbf{045}_{(8)}$ after the lapse of light emission time $\mathbf{20}_{(8)}$. In succession, writing selection of gradation level 5 is performed, but at the next timing number $\mathbf{046}_{(8)}$, the lowest digit is "6", which is already used in the lowest digit of the timing number $\mathbf{006}_{(8)}$ for writing selection of gradation level 2. Accordingly, at the point of further next timing number $\mathbf{047}_{(8)}$, writing selection is executed, and erasing selection is performed at the point of timing number $\mathbf{107}_{(8)}$ after the lapse of light emission time $\mathbf{40}_{(8)}$.

In respect of the gradation level 6, writing selection is practiced at the time point of timing number $\mathbf{110}_{(8)}$, and erasing selection is performed at the point of timing number $\mathbf{210}_{(8)}$ after the lapse of light emission time $\mathbf{100}_{(8)}$. The next timing number is $\mathbf{211}_{(8)}$, the data "1" of the lowest digit is same as that of writing selection for gradation level 0. Accordingly, as for the gradation level 7, writing selection is executed at further next timing number $\mathbf{212}_{(8)}$, and erasing selection is performed at the point of timing number $\mathbf{412}_{(8)}$ after the lapse of light emission time $\mathbf{200}_{(8)}$.

In this way, display data of all gradation levels can be written into for the first scanning line. Still more, the timing number in writing of each gradation level differs from the others in the data of the lowest digit.

These timing numbers are shown in the first line of FIG. 4 in order, in which the timing number of writing selection is shown at the left side of the slash (/) and the timing number of erasing selection, at the right side.

Next the second and subsequent scanning lines are described below. As for the second scanning line, writing selection is started at timing number $\mathbf{011}_{(8)}$, and first display data of gradation level 0 is written. This timing number $\mathbf{011}_{(8)}$ is obtained by adding "1" to the second digit of the timing number $\mathbf{001}_{(8)}$ for selecting writing of gradation level 0 for the first scanning line.

Since the light emission (display) time of gradation level 0 is $1_{(8)}$, the second scanning line is selected for erasing at the point of timing number $\mathbf{012}_{(8)}$.

Similarly, as for the gradation level 1, writing selection is executed at the point of timing number $\mathbf{013}_{(8)}$, and erasing selection is performed at the point of timing number $\mathbf{015}_{(8)}$. As for the gradation level 2 and later, the operation is exactly the same.

In respect of the third scanning line, writing selection is executed at the point of timing number $\mathbf{021}_{(8)}$, and display data of gradation level 0 is written. This timing number $\mathbf{021}_{(8)}$ is obtained by adding "2" to the second digit of the timing number $\mathbf{001}_{(8)}$ for selecting writing of gradation level for the first scanning line.

In respect of the fourth scanning line, writing selection of gradation level 0 is carried out at the point of $\mathbf{031}_{(8)}$, and in the fifth scanning line, at the point of $\mathbf{041}_{(8)}$. Similarly, thereafter, in the final thirty-second scanning line, writing selection of gradation level 0 is practiced at the time point of $\mathbf{371}_{(8)}$.

In the timing numbers of writing selection determined in this way, when the gradation level differs, the data in the lowest digit is different. On the other hand, at the same gradation level, when the scanning line differs, the data of higher digits are different. Therefore, the writing selection timing is not duplicated between different scanning lines or between different gradation levels.

These operations must be done within the period of one 4, field, and therefore one field must be $\mathbf{412}_{(8)}\times$T or more. Besides, since $\mathbf{1}_{(8)}$ of the lowest digit is assigned in the gradation level 0, writing sequence of next field must be started at the point when the lowest digit of the timing number is $\mathbf{1}_{(8)}$ after the timing number $\mathbf{412}_{(8)}$, that is, at timing number $\mathbf{421}_{(8)}$. Therefore, in this case, as one field, the shortest period is $\mathbf{420}_{(8)}\times$T.

In FIG. 4, the period of one field is $\mathbf{420}_{(8)}\times$T, and the timing number generating unit 131 outputs timing number $\mathbf{001}_{(8)}$ when receiving next timing signal from the timing generating unit 130 after output of timing number $\mathbf{420}_{(8)}$. Accordingly, when the obtained timing number for writing selection or erasing selection exceeds $\mathbf{420}_{(8)}$, at the point of the timing number subtracting $\mathbf{420}_{(8)}$ from that timing number, writing selection is executed or erasing selection is performed.

For example, the timing number for erasing selection of display data of gradation level 7 is obtained by adding "1" to the second digit of timing number $\mathbf{412}_{(8)}$ for erasing selection for the first scanning line. Hence, the original timing number is $\mathbf{422}_{(8)}$, but when exceeding $\mathbf{420}_{(8)}$, the timing number returns to $\mathbf{001}_{(8)}$, and, subtracting $\mathbf{420}_{(8)}$, at the point of timing number $\mathbf{002}_{(8)}$, erasing selection is performed. As for the writing selection timing of gradation level 7, after the eighteenth scanning line, at the point of the timing number subtracting $\mathbf{420}_{(8)}$, writing selection is executed.

Figures 5A, 5B:
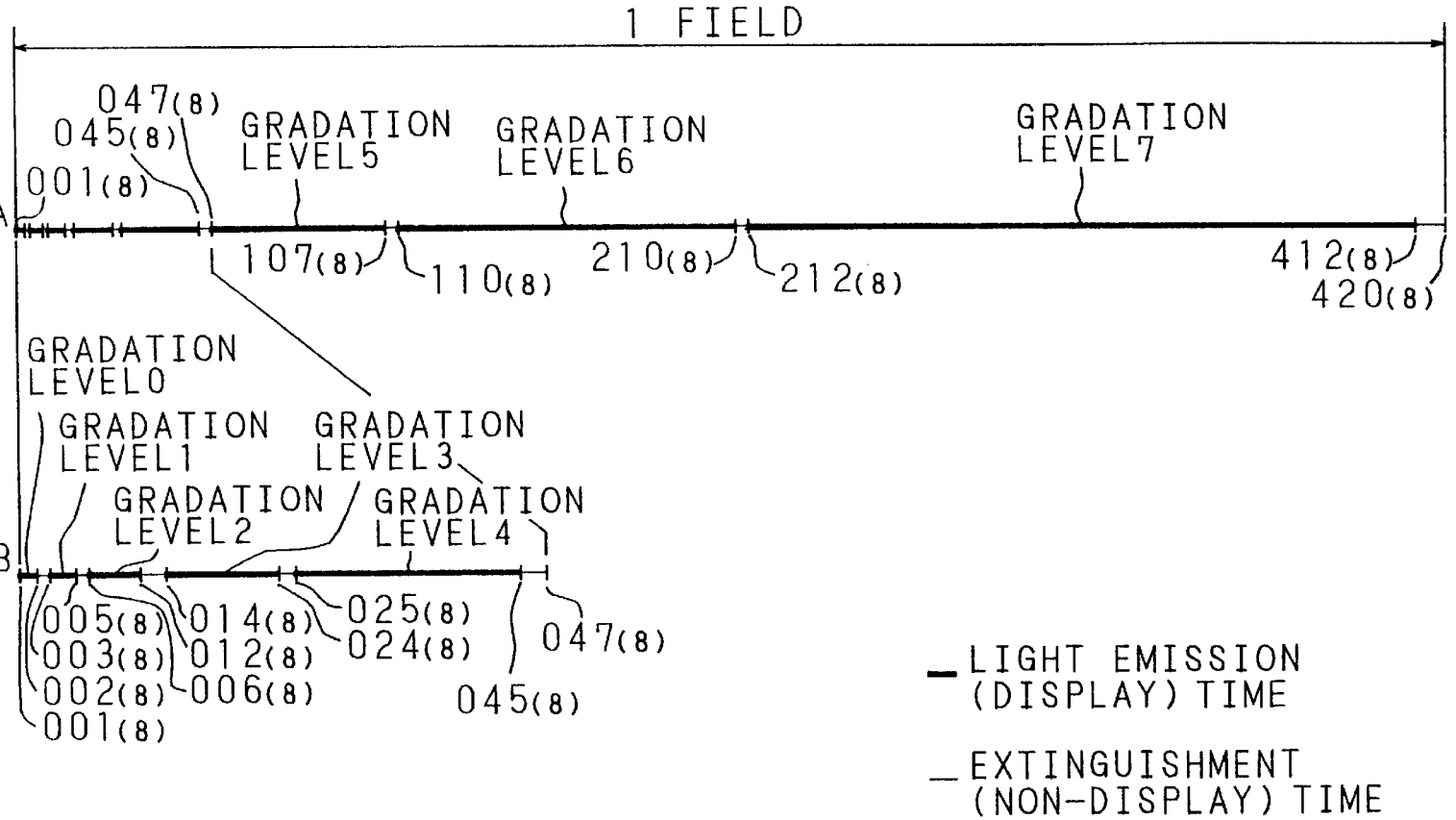
FIG. 5A is a diagram showing light emission (display) time of first scanning line in one field, in the case of using the timing number table in FIG. 4.
FIG. 5B is a magnified view of a part of FIG. 5A.

FIG. 5A is a diagram showing the light emission (display) time of the first scanning line in one field on the time axis, in a case of using the timing number table in FIG. 4. FIG. 5B is a magnified diagram of a part of FIG. 5A. The numerical values shown in the diagram are the timing number of writing selection and the timing number of erasing selection. The thick line portion in the diagram is the light emission (display) time, and the thin line portion is the extinguishment (non-display) time.

When the brightest image is displayed, the pixels are always lit in the light emission (display) time, but in the extinguishment (non-display) time, pixels are always put out regardless of the image data.

As understood from the diagram, by performing writing selection and erasing selection of display data according to the timing number table in FIG. 4, the extinguishment (non-display) time can be curtailed substantially, and the utility rate of light emission (display) time in one field can be enhanced.

The utility rate of light emission (display) time in this case is obtained to be 93.75% as follows. One field is $\mathbf{420}_{(8)}$ $(\mathbf{272}_{(10)})\times$T, supposing the calibration period to be T, and the period of $\mathbf{377}_{(8)}$ $(\mathbf{255}_{(10)})\times$T thereof is the light emission (display) time, and hence $$255\times T\div(272\times T)\times 100=93.75\% \quad (1)$$

This value of 93% is outstandingly high as compared with the value 25% of the utility rate of display time in the conventional image display device.

When the utility rate of the emission time can be enhanced, it is possible to display a brighter image by using a similar display unit to the display unit 10 in the conventional image display device. That is, according to the invention, the gradation image can be displayed more brightly without upgrading the performance of pixels for composing the display unit 10.

In this embodiment, the writing control unit 132 selects the scanning line for erasing, after erasing selection, it immediately selects the same scanning line for writing of next gradation level.

In a same pixel, if new display data is written, the existing display data is lost, and therefore in the case of writing immediately after selection of erasing, the writing control unit 132 may not select for erasing.

In the embodiment, similar to the conventional image display device shown in FIG. 1, the device of the invention may comprise auxiliary electrodes and auxiliary electrode lines to decrease the delay time of discharge start by discharging with preliminal auxiliarily.

In the embodiment, the specific digit of the timing number corresponding to the gradation level is the lowest digit, but it may be other predetermined digit than the lowest digit. For example, setting the second digit from the bottom as the specific digit, this digit may correspond to the gradation level, and the third and higher digits from the bottom may correspond to the scanning lines.

Embodiment 2

FIG. 6 is a chart showing a timing number table used in embodiment 2, in the same manner as in FIG. 4. The timing number table in FIG. 6 is a table used for $2^7$ gradation display, and the timing is controlled in accordance with the timing number in heptal notation.

The period of one field in this timing number table is described. Referring to the first scanning line, for example, erasing selection of gradation level 6 is performed at the timing number $\mathbf{263}_{(7)}$. Accordingly, as similar to the case in FIG. 4, when one field is determined so that writing selection of gradation level 0 may be executed at the point of the timing number when the lowest digit is "1" next to the timing number $\mathbf{263}_{(7)}$, one field is a period of $\mathbf{300}_{(7)}$.

However, there are 32 scanning lines in the display unit 10, and writing selection of the twenty-second scanning line is carried out at timing number $\mathbf{301}_{(7)}$. Hence, supposing one field to be a period of $\mathbf{300}_{(7)}\times T$, writing selection of the first scanning line and writing selection of the twenty-second scanning line are done in the same timing number. In the case of the image display device of flat panel type in the constitution as shown in FIG. 3, however, writing selection cannot be performed simultaneously in different scanning lines.

Therefore, in order that the timing numbers of all writing selections may not be duplicated, after writing selection of gradation level 0 in the thirty-second scanning line which is the final scanning line, writing sequence of next field must be started. That is, one field must be determined so that the writing selection of gradation level 0 of the first scanning line of the next field may be done at the timing number when the lowest digit is "1" next to the timing number $\mathbf{431}_{(7)}$, as a consequence one field must be a period of $\mathbf{440}_{(7)}$ ($\mathbf{224}_{(10)}$).

Figures 7A, 7B:
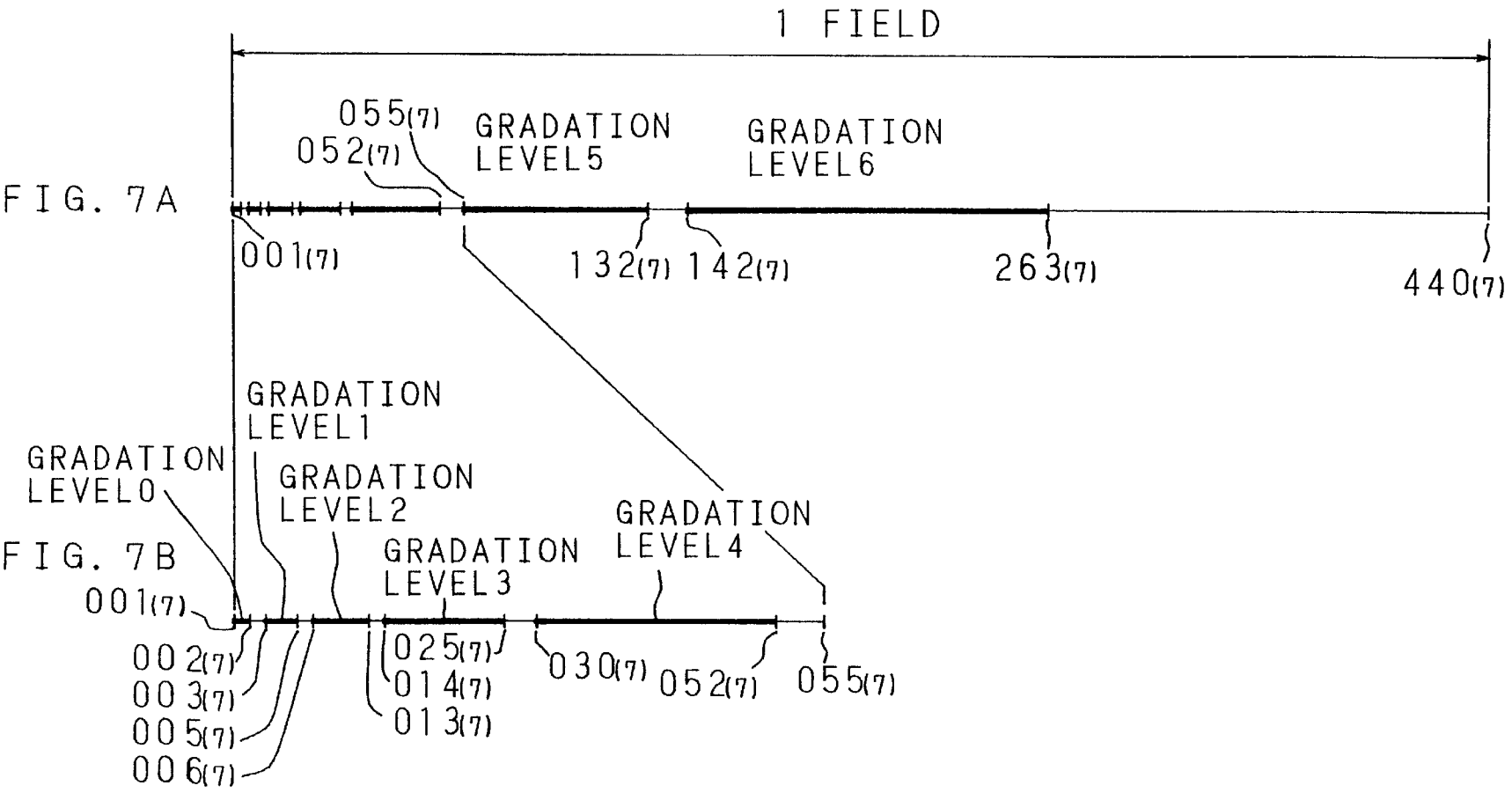
FIG. 7A is a diagram showing light emission (display) time of first scanning line in one field, in the case of using the timing number table in FIG. 6.
FIG. 7B is a magnified view of a part of FIG. 7A.

FIG. 7A shows a diagram of the light emission (display) time of the first scanning line in one field on the time axis, by using the timing number table in FIG. 6. FIG. 7B is a partially magnified view of FIG. 7A. The numerical values shown in the diagram are the timing number of writing selection and the timing number of erasing selection. The thick line portion in the diagram is the light emission (display) time, and the thin line portion is the extinguishment (non-display) time.

The utility rate of light emission (display) time in this case is obtained to be 56.70% as follows. One filed is $\mathbf{440}_{(7)}$ ($\mathbf{224}_{(10)}$)÷T, and the period of $\mathbf{127}_{(10)}\times T$ thereof is the light emission (display) time, and hence $$127\times T\div(224\times T)\times 100=56.70\% \quad (2)$$

This value is lower than in embodiment 1, but is a much high value as compared with the utility rate 25% of display time in the conventional image display device.

Embodiment 3

Figure 8:
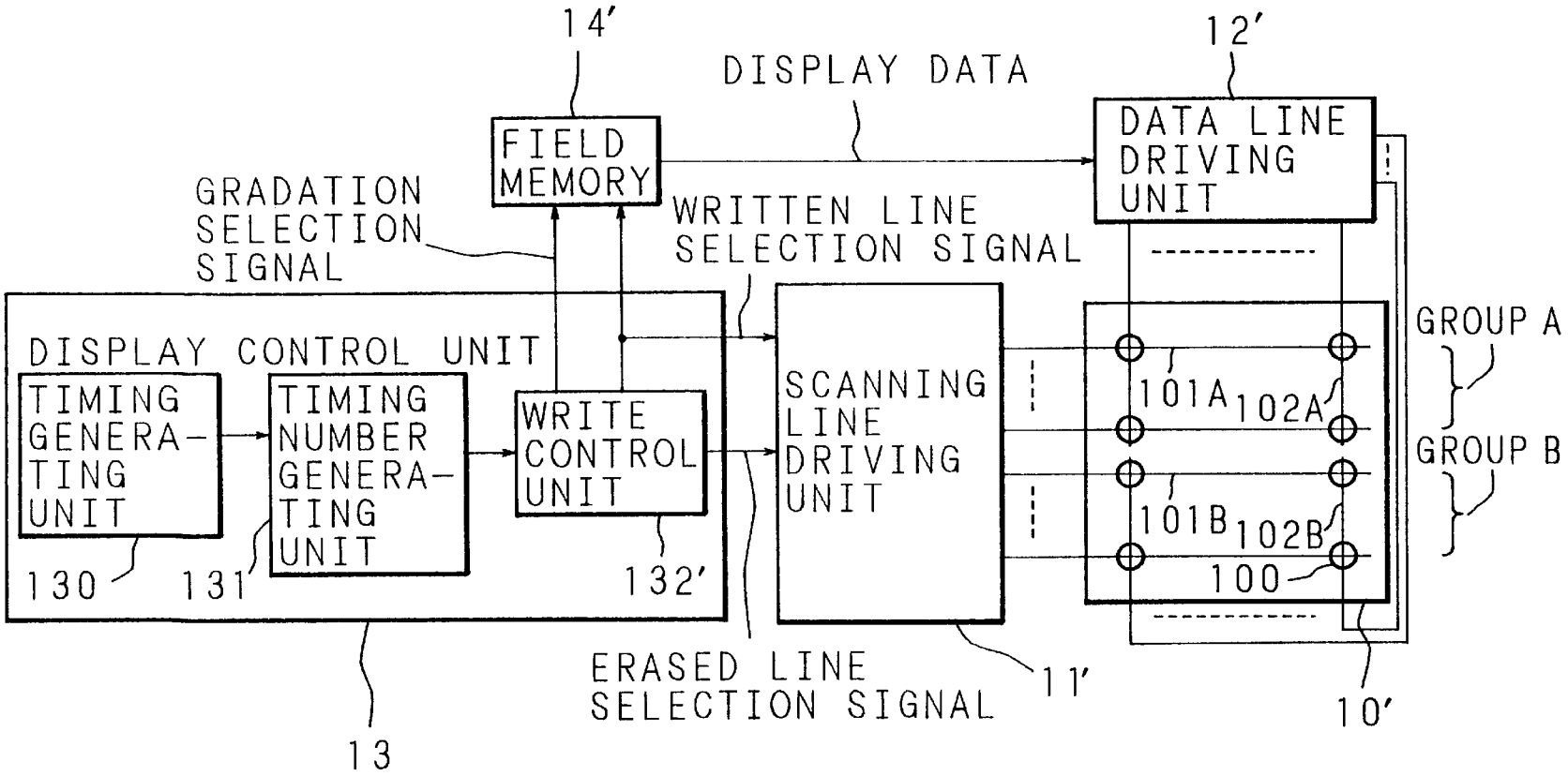
FIG. 8 is a block diagram showing a constitution of an image display device according to embodiment 3.

FIG. 8 is a block diagram showing a constitution of an image display device in embodiment 3. Same blocks as the blocks shown in FIG. 3 are identified with same reference numerals, and explanations are omitted. In this image display device, scanning lines for composing a display unit 10' are divided, for example, into two groups, and an independent data line is provided for each group. That is, of the 32 scanning lines, upper 16 lines are scanning lines 101A of a group A, and remaining lower 16 lines are scanning lines 101B of a group B. Data lines 102A exclusive for the group A and data lines 102B exclusive for the group B are provided.

A writing control unit 132' selects the scanning line for writing or erasing similar to the case in FIG. 3, and selects one scanning line each from the group A and the group B. A scanning line driving unit 11' drives the selected scanning lines for both the groups A and B. That is, two scanning lines are simultaneously selected for writing. Herein, the writing control unit 132' selects not two scanning lines from the 32 scanning lines relating to a same data line, but one scanning line from 16 scanning lines. And according to the result of selection, the scanning line driving unit 11' drives one scanning line each from the group A and the group B.

On the other hand, a field memory 14' reads out and outputs display data for the group A and display data for the group B on the basis of the selected scanning line and the selected gradation level. A data line driving unit 12' applies display data simultaneously to the data line 102A of the group A and data line 102B of the group B, and writes in pixels of two lines.

FIG. 9 is a diagram showing a timing number table used in the write control device 132'.

This diagram is for $2^7$ gradation display on the basis of the timing numbers expressed in heptal numeration. Accordingly, the timing numbers of writing selection and erasing selection of the first scanning line coincide completely with the case of embodiment 2 (FIG. 6).

However, as shown in FIG. 8, since the scanning lines are divided into two groups, in FIG. 9, when 16 scanning lines are selected, writing selection of one field is terminated. As compared with the case of embodiment 2 (FIG. 6), therefore, the period of one field is substantially shortened.

Herein, the period of one field in FIG. 9 will be determined. The timing number of erasing selection of gradation level 6 for the first scanning line is $\mathbf{263}_{(7)}$, and the timing number when the lowest digit next becomes "1" is $\mathbf{301}_{(7)}$. On the other hand, the timing number of writing selection of gradation level 0 for the sixteenth scanning line is $\mathbf{211}_{(7)}$. Therefore, when the shortest period of one field is $\mathbf{300}_{(7)}$, the writing selection timing does not be duplicated.

Therefore, determining the utility rate of the light emission (display) time, one field is a period of $\mathbf{300}_{(7)}$ ($\mathbf{147}_{(10)}$)× T, and it is hence $$127\times T\div(147\times T)\times 100=86.39\% \quad (3)$$

This value is not only higher than the utility rate 25% of the display time in the conventional image display device, but also far higher than the case of embodiment 2.

Generally, in the image display device of flat type, in a case where the number of gradation levels M is equal to the number of luminance levels N, to form an image of $2^N$ gradations by N images of single gradation, the gradation levels of from 0 to N−1 are used, and a period of more $2^N-1$ or more is needed from writing selection of gradation level 0 of the first scanning line until erasing selection of gradation level N−1 of the first scanning line. That is, the erasing section of gradation level N−1 of the first scanning line is effected after the point of timing number $2^N$ On the other hand, supposing the number of scanning lines to be L, in the case of L−th scanning line where writing selection of gradation level is effected finally, its timing number is given as the product of the number of scanning lines L and the number of luminance levels N. Hence, as far as the timing number $2^N$ and timing number L×N satisfy the relation of $$L \times N \leq 2^N \quad (4)$$

one field may be the shortest period.

However, when the base of the timing number, that is, the number of gradation levels M is larger than the number of images of single gradation N, the timing number of writing selection of the L–th scanning line is given as the product of the number of scanning lines L and the base M of the timing number. In such a case, therefore, when satisfying the relation of the formula using the base M of the timing number $$L \times M \leq 2^M \quad (5)$$

one field may be the shortest period.

In embodiment 2 (FIGS. 6 and 7), since the number of scanning lines is many, formula (4) is not satisfied, and the period of one field is long, whereby the utility rate of light emission (display) time is lowered. By contrast, in embodiment 3 (FIGS. 8 and 9), since the scanning lines are divided into two groups A and B, the number of scanning lines in each group satisfies formula (4), and the period of one field may be shortest. Hence, in embodiment 3, as compared with the case of embodiment 2, the utility rate of the light emission (display) time is enhanced, and a brighter image may be displayed.

Embodiment 4

Figure 10:
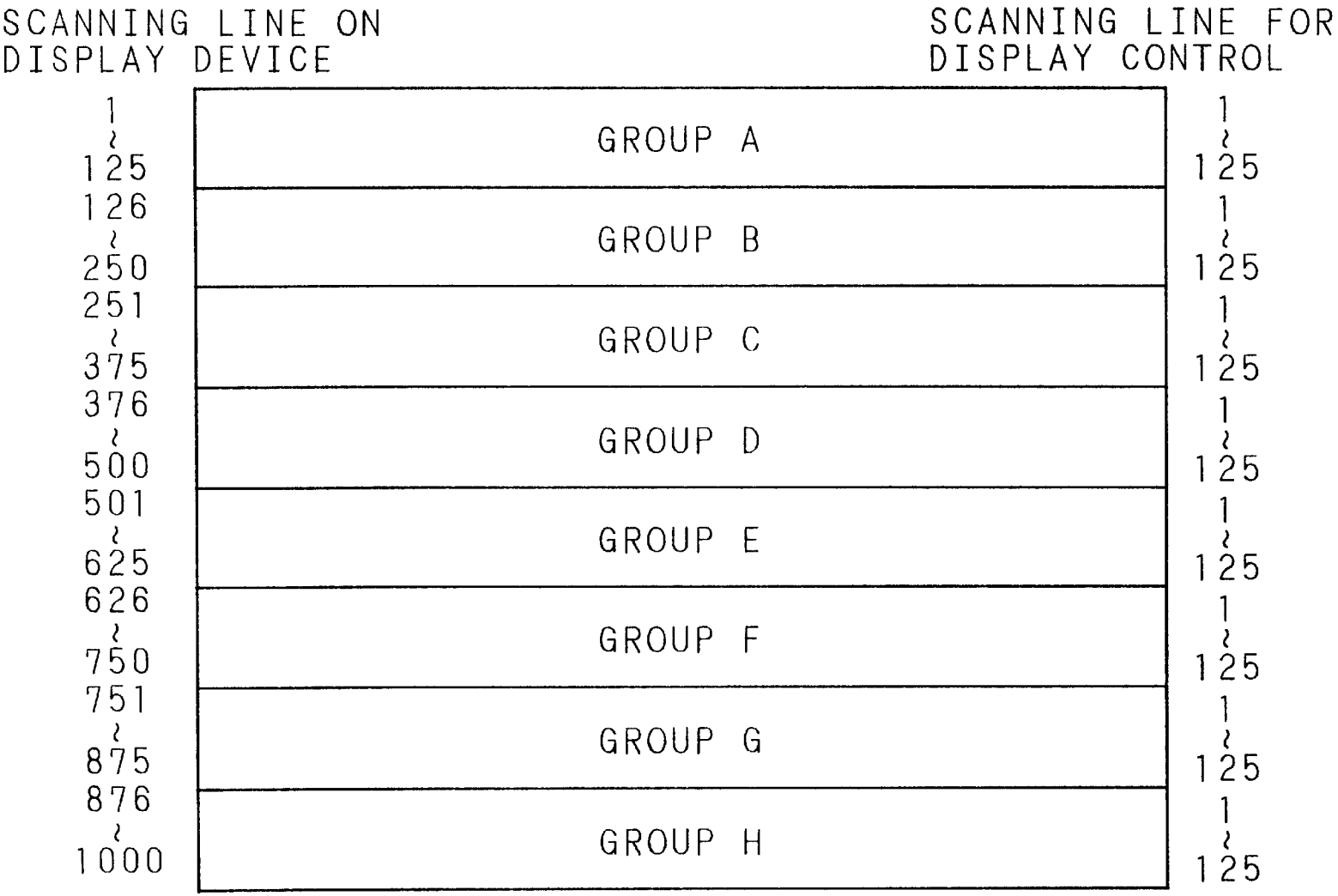
FIG. 10 is a conceptual diagram showing a display unit of an image display device in embodiment 4.

FIG. 10 is a conceptual diagram showing a display unit 10 of an image display device according to embodiment 4. In this image display device, the display unit 10' has 1000 scanning lines, and these scanning lines are divided into, for example, eight groups A to H. Hence, in each of the groups A to H, the scanning line is selected simultaneously, so that different data can be written simultaneously into the groups A to H.

The display unit of the image display device of this kind is usually composed of about hundreds or thousands of scanning lines. For example, the image display device having 1000 scanning lines in the display unit is described below.

Supposing the number of scanning lines L to be 1000, the minimum number of luminance levels N (=gradation levels number M) satisfying the condition of formula (4) is 14, and the period of one field can be composed of about $2^{14}$ timing numbers. Therefore, supposing the field frequency of the image display device to be 60 Hz, that is, 1/60 sec per field, the frequency of timing signal is $$2^{14} \times 60 = 983{,}040 \text{ (Hz)} \quad (6)$$

As far as the circuit of the image display device operates at a frequency of about 1 MHz or more, the number of scanning lines does not matter. Owing to the circuit configuration, sometimes, it may be forced to operate at lower frequency. Circuit elements capable of operating at high speed are generally expensive, and therefore when the image display device is operated at a frequency of about 1 MHz, the manufacturing cost of the entire device is increased.

However, by dividing 1000 scanning lines into eight groups, the assumed number of scanning lines can be decreased to $$1000/8 = 125 \text{ (lines)} \quad (7)$$

and at this time, the number of luminance levels N (=gradation levels number M) to satisfy formula (4) is 11. Hence, when the field frequency is 60 Hz, the frequency of timing signal is $$2^{11} \times 60 = 122{,}880 \text{ (Hz)} \quad (8)$$

As understood from the above description, by dividing the scanning lines into groups and decreasing the assumed number of scanning lines L, the number of luminance levels N (when N=M) or the number of gradation levels M (when M>N) for satisfying formula (4) or (5) may be decreased. While one field is composed of about $2^N$ timing signals (N=M) or $2^M$timing signals (M>N), the period of one field is predetermined (1/60 sec), and by decreasing the number of luminance levels N (when N=M) or the number of gradation levels M (when M>N), the frequency of timing signal, that is, the operating speed of the control circuit can be decreased.

Embodiment 5

Figure 11:
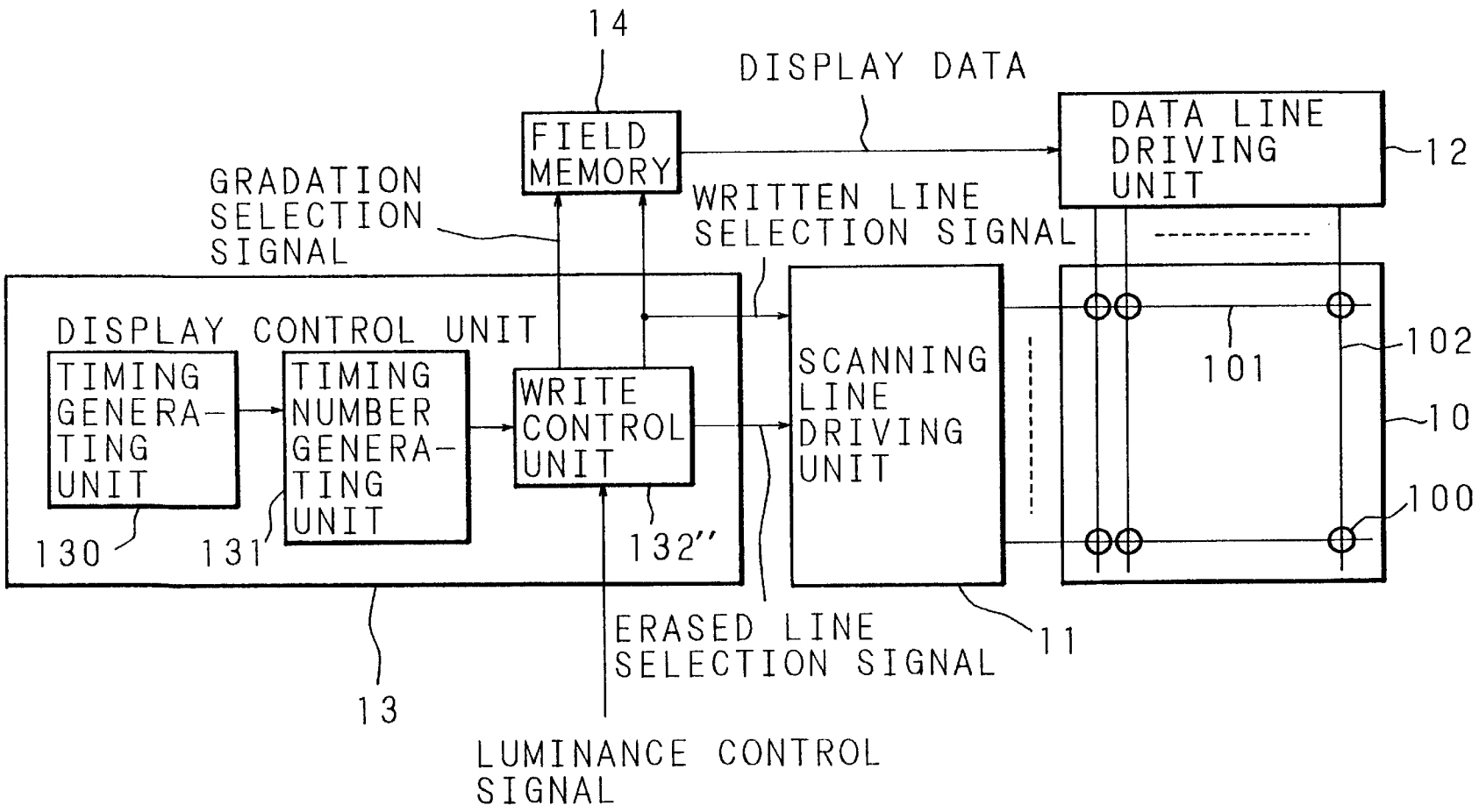
FIG. 11 is a block diagram showing a constitution of an image display device in embodiment 5.

FIG. 11 is a block diagram showing a constitution of an image display device according to embodiment 5, and FIG. 12 is a conceptual diagram showing a method of controlling the brightness of the entire image displayed by this image display device.

In this image display device, a display unit 10 is composed of 1000 scanning lines, and these scanning lines are not divided into groups. Accordingly, the number of luminance levels N or the number of gradation levels M for satisfying formula (4) or (5) is 14. Therefore, in this image display device, an image of $2^{14}$ gradations can be displayed. On the other hand, the number of gradations actually required for image display is $2^{10}$ gradations at most. When displaying an image of $2^{10}$ gradations, therefore, the brightness of the display image can be controlled on the a) whole for the portion corresponding to 24 gradations.

In the image display device shown in FIG. 11, a luminance control signal for controlling the brightness of the screen is inputted to a write control unit 132". The write control unit 132" changes the corresponding relation of gradation level and luminance level (the timing number corresponding to luminance level) on the basis of this luminance control signal. That is, when the luminance control signal is different, even in the case of same display data, writing selection or erasing selection is done at different timing.

FIG. 12 is a diagram showing a method of shifting display data in order to control the brightness of the entire display image. In the diagram, D0 denotes the zeroth bit (LSB) of display data, D1 is the first bit of display data, and the rest is similar, D9 is the ninth bit (MSB) of display data. By using these display data D0 to D9, an image of $2^{10}$ gradations is displayed. On the other hand, the gradation levels that can be displayed are 14 levels from level 0 to level 13, and display data D0 to D9 are displayed in any one of the gradation levels, and by varying this corresponding relation, the screen brightness is controlled.

For example, when displaying the image by setting the screen brightness at maximum, display data D0 is written at the timing of gradation level 4 (light emission time is $2^4$ times of calibration period: $2^4$T), display data D1 is written at the timing of gradation level 5 (light emission time is $2^5$T), and the rest is similar, display data D9 is written at the timing of gradation level 13 (light emission time is $2^{13}$T).

When displaying the image by setting the screen brightness at ½ of maximum, display data D0 is written at the timing of gradation level 3 (light emission time is $2^3$T), display data D1 is written at the timing of gradation level 4

(light emission time is $2^4$T), and the rest is similar, display data D9 is written at the timing of gradation level 12 (light emission time is $2^{12}$T).

Similarly, when the brightness of the screen is set at ¼, ⅛ or 1/16 of maximum, the gradation level corresponding to display data D0 to D9 is shifted sequentially.

Herein, the brightness of the screen is controlled at about $1/2^i$ of maximum brightness (i being an integer from 0 to 4), but the corresponding relation of each bit of display data and each gradation level is not limited to the above method.

For example, to control the brightness of the screen so as to be 1/j of maximum brightness (j being a value from 1 to 16), the write control unit may determine so that the display period of each gradation level is to be time obtained from $$\text{Integer part } [(2^{14}-1)\div 1023\div j]\times 2^m \ (m \text{ being an integer of 0 to 9}) \quad (9)$$

In this way, instead of changing the corresponding relation of the display data and gradation level, the lighting (display) period corresponding to each gradation level is changed, and the luminance itself is changed, so that the image be displayed at brightness of ⅓ times, ⅕ times or the like, of the maximum brightness.

For example, when displaying the screen at brightness of ⅓ times of the maximum, from $$(2^{14}-1)\div 1023\div 3=5.338 \quad (10)$$

the integer part in formula (9) is 5. Therefore, the display period of each gradation level should be a period of 5 times each. That is, the light emission time for display data D0 is $5\times 2^0$T, the light emission time for display data D1 is $5\times 2^1$T, and the rest is similar, the light emission time for display data D9 is $5\times 2^9$T.

As the invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

I claim:

1. An image display method for displaying an image of $2^N$ gradations by forming N images of single gradation in one field, each image being different in gradation level set for scanning line selection sequence, in which each image of single gradation includes all scanning lines, in a display unit having pixels disposed in a matrix on scanning lines and data lines orthogonal thereto, comprising the steps of:

making previously a write timing number table, in which each timing number is expressed in a numeration with a base of M (M≧N: M being the number of the gradation levels) and has plural digits, data of a specific digit corresponding to any one of plural gradation levels for the respective images of single gradation, and data of other digits being different in every scanning line;

generating a timing signal cyclically;

generating a timing number by counting the timing signals;

selecting a scanning line and a gradation level by referring the timing number to the write timing number table; and writing display data corresponding to the selected gradation level in batch into the pixels on the selected line.

2. An image display method of claim 1, wherein after lapse of a display period corresponding to the gradation level in writing for the selected scanning line, the same scanning line is selected for erasing data, and later the same scanning line is selected at the timing when the data of the specific digit of the timing number corresponds to next gradation level and display data is written.

3. An image display method of claim 1, wherein the data of the lowest digit of the timing number corresponds to the gradation level, and the data of higher digits than this digit are different in every scanning line.

4. An image display method of claim 1, wherein the scanning lines are divided into plural groups so that the product of the number of scanning lines belonging to each group and the number M of the gradation levels may be $2^M$ or less, and the scanning line selection is executed according to the timing number parallel to the divided groups.

5. An image display method of claim 1, wherein the scanning lines are divided into plural groups so that the product of the number of scanning lines belonging to each group and the number N of images of single gradation may be $2^N$ or less when the number M of the gradation levels is equal to the number N of images of single gradation, and the scanning line selection is executed according to the timing number parallel to the divided groups.

6. An image display method of claim 1, wherein the brightness of display image is controlled by shifting each gradation level corresponding to each image of single gradation on the basis of a predetermined luminance of the entire screen when the number M of gradation levels is greater than the number N of images of single gradation.

7. An image display method of claim 1, wherein the brightness of display image is controlled by varying the luminance itself corresponding to each image of single gradation when the number M of gradation levels is greater than the number N of images of single gradation.

8. An image display device for displaying an image of $2^N$ gradations by forming N images of single gradation in one field, each image being different in gradation level set for scanning line selection sequence, in which each image of single gradation includes all scanning lines, comprising:

a display unit having pixels arranged in a matrix on scanning lines and data lines orthogonal thereto;

means for generating a timing signal cyclically;

timing number generating means for generating a timing number by counting the timing signals;

means for storing a write timing number table made previously in which each timing number is expressed in a numeration with a base of M (M≧N: M being the number of the gradation levels), data of a specific digit of the timing number corresponds to any one of plural gradation levels for the respective images of single gradation, and data of other digits being different in every scanning line;

write control means for selecting a scanning line and a gradation level by referring the timing number to the write timing number table and controlling write timing;

a scanning line driving unit for driving a selected scanning line;

a memory unit for storing display data of N images of single gradation, and reading out specific display data according to the selected scanning line and the selected gradation level; and data line driving unit for driving data lines to write the read-out display data in each of the pixels on the selected scanning line.

9. An image display device of claim 8, further comprising;

means for storing an erase timing number table expressed in the numeration with the base of M; and erase control means for selecting one scanning line by referring the converted timing number generated by the timing number generating means to the erase timing number table and controlling the erase timing of display data, wherein the erase timing number table has timing numbers for selecting a scanning line selected by the write control means for erasing after lapse of display period corresponding to the gradation level at the time of writing, and the write timing number table has timing numbers for selecting again the scanning line selected for erasing, at a timing when the data of a specific digit of the timing number corresponds to next gradation level, after selection for erasing.

10. An image display device of claim 8, wherein the timing number is specified so that the data of the lowest digit corresponds to the gradation level, while data of higher digits than this digit are different in every scanning line.

11. An image display device of claim 8, wherein scanning lines are divided into plural groups so that the product of the number of scanning lines belonging to each group and the number M of the gradation levels may be $2^M$ or less, the data lines are provided independently in each group, and the write control means selects the scanning line in each group.

12. An image display device of claim 8, wherein scanning lines are divided into plural groups so that the product of the number of scanning lines belonging to each group and the number N of images of single gradation may be $2^N$ or less when the number M of the gradation levels is equal to the number N of images of single gradation, the data lines are provided independently in each group, and the write control means selects the scanning line in each group.

13. An image display device of claim 8, wherein the write control means controls the brightness of display image by shifting each gradation level corresponding to each image of single gradation on the basis of a predetermined luminance when the number M of the gradation levels is greater than the number N of images of single gradation.

14. An image display device of claim 8, wherein the write control means changes the luminance corresponding to each image of single gradation when the number M of the gradation levels is greater than the number N of images of single gradation.

* * * * *